US005926159A

United States Patent [19]

Matsuzaki et al.

[11] Patent Number: 5,926,159

[45] Date of Patent: Jul. 20, 1999

[54] DISPLAY CONTROL APPARATUS AND METHOD THEREFOR CAPABLE OF LIMITING AN AREA FOR PARTIAL REWRITING

[75] Inventors: Eiichi Matsuzaki, Kawasaki; Kenzoh Ina; Toshiyuki Nobutani, both of Yokohama; Masami Shimakura, Tokyo; Junichi Tanahashi, Yokohama; Kenichiro Ono, Kawasaki; Hajime Morimoto, Tokyo; Tatsuya Sakashita, Yokohama, all of Japan

[73] Assignee: Canon Kabushiki Kaisha, Tokyo, Japan

[21] Appl. No.: 08/395,210

[22] Filed: Feb. 27, 1995

Related U.S. Application Data

[63] Continuation of application No. 08/062,217, May 18, 1993, abandoned

[30] Foreign Application Priority Data

May 19, 1992 [JP] Japan ..... 4-126167

[51] Int. Cl.[6] ..... G09G 3/36

[52] U.S. Cl. ..... 345/97; 345/196

[58] Field of Search ..... 340/784, 799, 340/798, 765, 803, 804; 345/87, 92, 97, 185, 189, 191, 196, 507, 188, 193, 515, 516; 349/33, 34, 49

[56] References Cited

U.S. PATENT DOCUMENTS

| | | | |
|---|---|---|---|
| 4,693,563 | 9/1987 | Harada et al. | 340/784 |
| 4,964,699 | 10/1990 | Inoue | 350/332 |

FOREIGN PATENT DOCUMENTS

| | | | |
|---|---|---|---|
| 0318050 | 2/1989 | European Pat. Off. . | |
| 0361471 | 4/1990 | European Pat. Off. . | |
| 0368117 | 5/1990 | European Pat. Off. . | |
| 0464620 | 1/1992 | European Pat. Off. . | |
| 0478381 | 4/1992 | European Pat. Off. | 340/784 |
| 0519717 | 12/1992 | European Pat. Off. . | |
| 6276357 | 4/1962 | Japan . | |

*Primary Examiner*—Chanh Nguyen
*Attorney, Agent, or Firm*—Fitzpatrick, Cella, Harper & Scinto

[57] ABSTRACT

A display control apparatus includes a memory for storing information supplied from a processing apparatus, a detector for detecting a storage portion of the information, a display controller for performing display on a display device on the basis of the information stored in the portion detected by the detector, and a limiting unit for limiting the portion detected by the detector.

11 Claims, 19 Drawing Sheets

134
TIMING CCT
REFRESH/PARTIAL REWRITE
INTERLACE MODE
135
COUNTER
FRAME END
HSYNC
130
MODE 0 TABLE
131
MODE 1 TABLE
132
MODE 2 TABLE
133
DECODER
FLAG COUNTER VALUE
MODE SELECT

| FIG. 10A | FIG. 10B |
|---|---|

FIG. 19

| MODE NO. | FLAG COUNTER VALUE | NO. OF PARTIAL REWRITE |
|---|---|---|
| 0 | 0 | 0 |
| | 1 ~ 50 | = FLAG COUNTER VALUE |
| | 51 ~ | 20 |
| 1 | 0 ~ | = FLAG COUNTER VALUE |
| 2 | 0 | 0 |
| | 1 ~ S | = FLAG COUNTER VALUE |
| | (S+1) ~ | S |

S : VALUE OF SIZE REGISTER 151

DISPLAY CONTROL APPARATUS AND METHOD THEREFOR CAPABLE OF LIMITING AN AREA FOR PARTIAL REWRITING

This application is a continuation of application Ser. No. 08/062,217, filed May 18, 1993, now abandoned.

BACKGROUND OF THE INVENTION

1. Field of the Invention

The present invention relates to a display control apparatus and a method therefor and, more particularly, to a display control apparatus and a method therefor, suitable for a display device having a display element having, e.g., a ferroelectric liquid crystal as an operation medium, for updating a display state so as to be able to hold the updated display state upon application of an electric field.

2. Related Background Art

A display device is generally used in an information processing system or the like, as an information display means having a function of visually expressing information. A CRT display device is most popular as such a display device. A CTR has a large volume because a considerably large length is required in the direction of thickness of the display screen. A compact display device cannot be obtained as a whole. Degrees of freedom in use of an information processing system having a CTR as a display device, i.e., degrees of freedom in installation locations and portability, are limited.

To compensate for these drawbacks, a liquid crystal display device (to be referred to as an LCD hereinafter) can be used. That is, according to the LCD, the display device can be made compact (particularly low profile) as a whole. A display (to be referred to as an FLCD or FLC display hereinafter) using a liquid crystal cell containing a ferroelectric liquid crystal (to be referred to as an FLC hereinafter) is included in such LCDs. One of the characteristic features of the FLCD lies in that the liquid crystal cell has a storage characteristic of a display state upon application of an electric field. More specifically, the FLCD has the liquid crystal cell having a sufficiently small thickness, FLC molecules are aligned in a first or second stable state in accordance with the direction of electric field application, and this aligned state is maintained after the electric field is removed. The FLCD has a storage characteristic by the bistable properties of the FLC molecules. The details of the FLC and FLCD are described in, e.g., Japanese Patent Application No. 62-76357 (U.S. patent application Ser. No. 174,980 filed on Mar. 29, 1988).

Unlike in the CTR and other liquid crystal display devices, the FLCD can be driven to obtain a sufficient time margin in a continuous refresh driving cycle of the display screen. In addition to the continuous refresh driving, partial rewrite driving for updating the display state of only a portion subjected to updating on the display screen can be performed.

When the FLCD is used as a display device in an information processing system by the same display control as that of the CRT, an FLC display updating time is relatively long. For example, the FLCD cannot often cope with a change in display information (e.g., a cursor, a character input, and scrolling), the display state of which must be immediately updated. Therefore, partial rewrite driving as one of the characteristic features of the FLCD is performed to increase an apparent display speed.

A conventional partial rewrite technique is to store all lines having the updated display contents and rewrite all the lines having the updated display contents by partial rewrite operations. For this reason, independent jobs are to be performed on a plurality of windows as in a multiwindow system, and the following problem is posed. For example, when character scrolling is being performed in a window different from a current window (to be referred to as an active window hereinafter), a partial rewrite operation is performed in both the active window and the window subjected to scrolling to result in a decrease in display content rewrite speed. Therefore, partial rewrite operations cannot be sufficiently enhanced.

SUMMARY OF THE INVENTION

It is an object of the present invention to provide a display control apparatus and a method therefor, capable of discriminating an active window in independent operations using a plurality of windows as in a multiwindow system and preferentially performing a partial rewrite operation of the active window, thereby performing appropriate partial rewrite driving for improving the display quality of the active window.

It is another object of the present invention to provide a display control apparatus and a method therefor, wherein a means, accessed from a host device such as a CPU, for performing a partial rewrite cycle of a non-updated portion in a process for sequentially performing a sequential rewrite cycle of the entire screen, is arranged to discriminate one of the windows as an active window and perform partial rewrite driving of the active window when a plurality of windows are present on the display screen, thereby rewriting the active window at high speed and obtaining a display screen having high quality.

BRIEF DESCRIPTION OF THE DRAWINGS

FIG. 19 is a table showing values of a mode 0 table, a mode 1 table, and a mode 2 table.

DETAILED DESCRIPTION OF THE PREFERRED EMBODIMENTS

A preferred embodiment of the present invention will be described with reference to the accompanying drawings.

Figure 1:
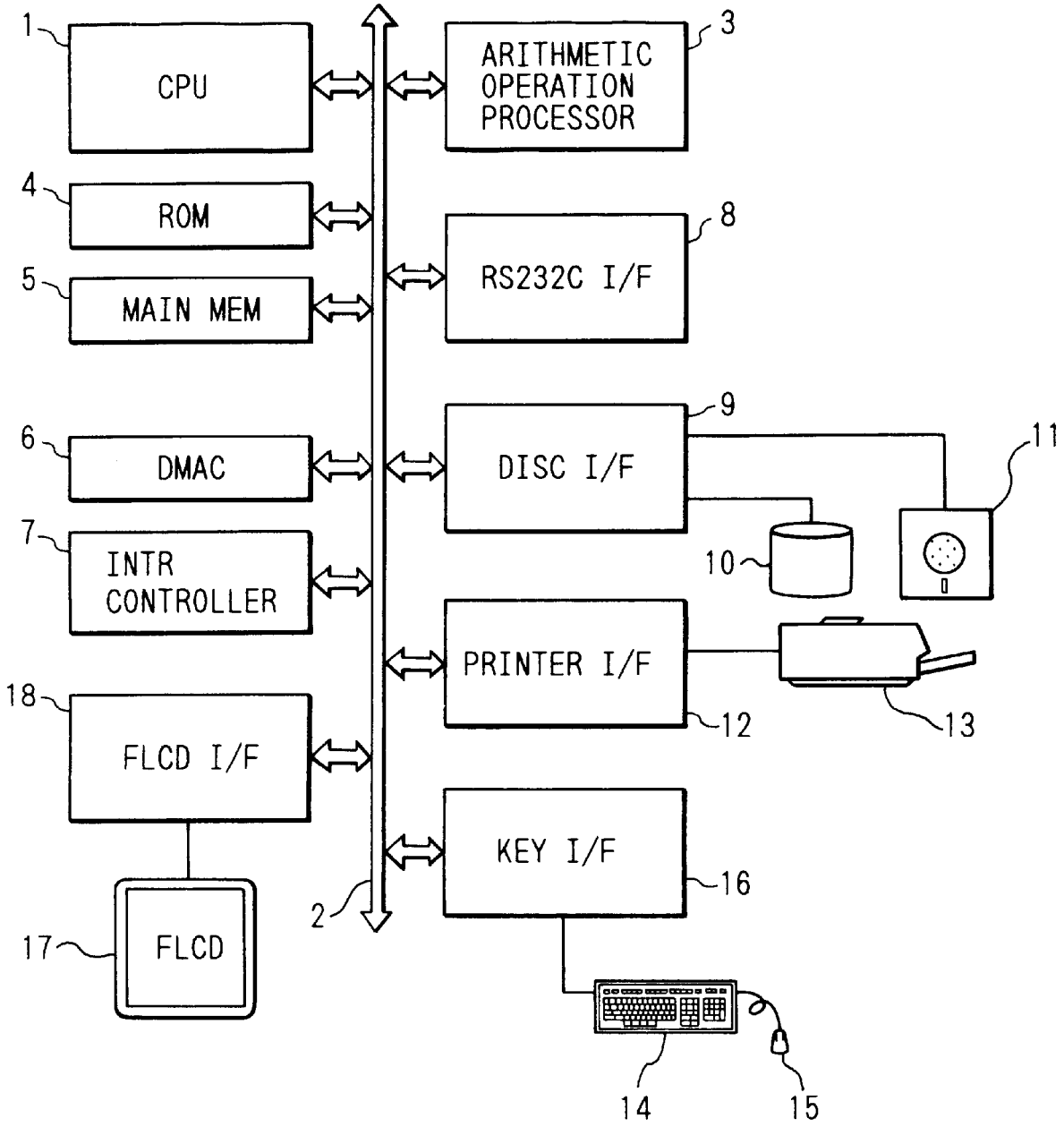
FIG. 1 is a block diagram of an information processing apparatus incorporating a display control apparatus according to an embodiment of the present invention.

FIG. 1 is a block diagram of an information processing system incorporating a display control apparatus according to an embodiment of the present invention.

Referring to FIG. 1, the information processing system includes a CPU 1, a system bus 2, an arithmetic operation processor 3, a ROM 4, a main memory 5, a DMA (Direct Memory Access) controller (to be referred to as a DMAC hereinafter) 6, an interrupt (INTR) controller 7, an RS232C interface (I/F) 8, a disc I/F 9, a hard disc drive 10, a floppy disc drive 11, a printer I/F 12, a printer 13, a keyboard 14, a mouse 15, a key I/F 16, an FLCD (FLC display) 17, and an FLCD I/F 18. The CPU 1 controls the overall operation of the information processing system. The system bus 2 comprises an address bus, a control bus, and a data bus. The arithmetic operation processor 3 exclusively performs arithmetic operations. The ROM 4 stores programs for initializing the entire system. The main memory 5 stores programs and is used as a work area. The DMAC 6 directly exchanges data with I/Os without going through the CPU 1. The interrupt controller controls an interrupt between the CPU 1 and I/Os when an interrupt request is input from an I/O device. The RS232C I/F 8 performs communication through a modem using a public or leased line. The disc I/F 9 interfaces the hard disc drive 10 and the floppy disc drive 11. The printer 13 is represented by and impact printer and a non-impact printer such as a laser beam printer or an ink-jet printer. The printer I/F 13 interfaces the printer 12. The keyboard 14 is used to enter characters such as letters and numerical values and other inputs. The mouse 15 serves as a pointing device. The key I/F 16 interfaces the keyboard 14 and the mouse 15. The FLCD 17 can be arranged using a display disclosed in Japanese Laid-Open Patent Application No. 63-243993 filed by the present applicant. The FLCD I/F 18 interfaces the FLCD 17.

In the information processing system obtained by connecting the above components to each other, a general system user performs operations in correspondence with various kinds of information displayed on the display screen of the FLCD 17. More specifically, image information and the like from the RS232C I/F 8, the hard disc drive 10, the floppy disc drive 14, and the mouse 15 or operation information and the like representing user's system operations and read out from the ROM 4 and the main memory 5 are displayed on the display screen of the FLCD 17, and the user watches the display contents to edit information and designate system inputs. The respective components described above constitute display information supply means for the FLCD 17.

Figure 2:
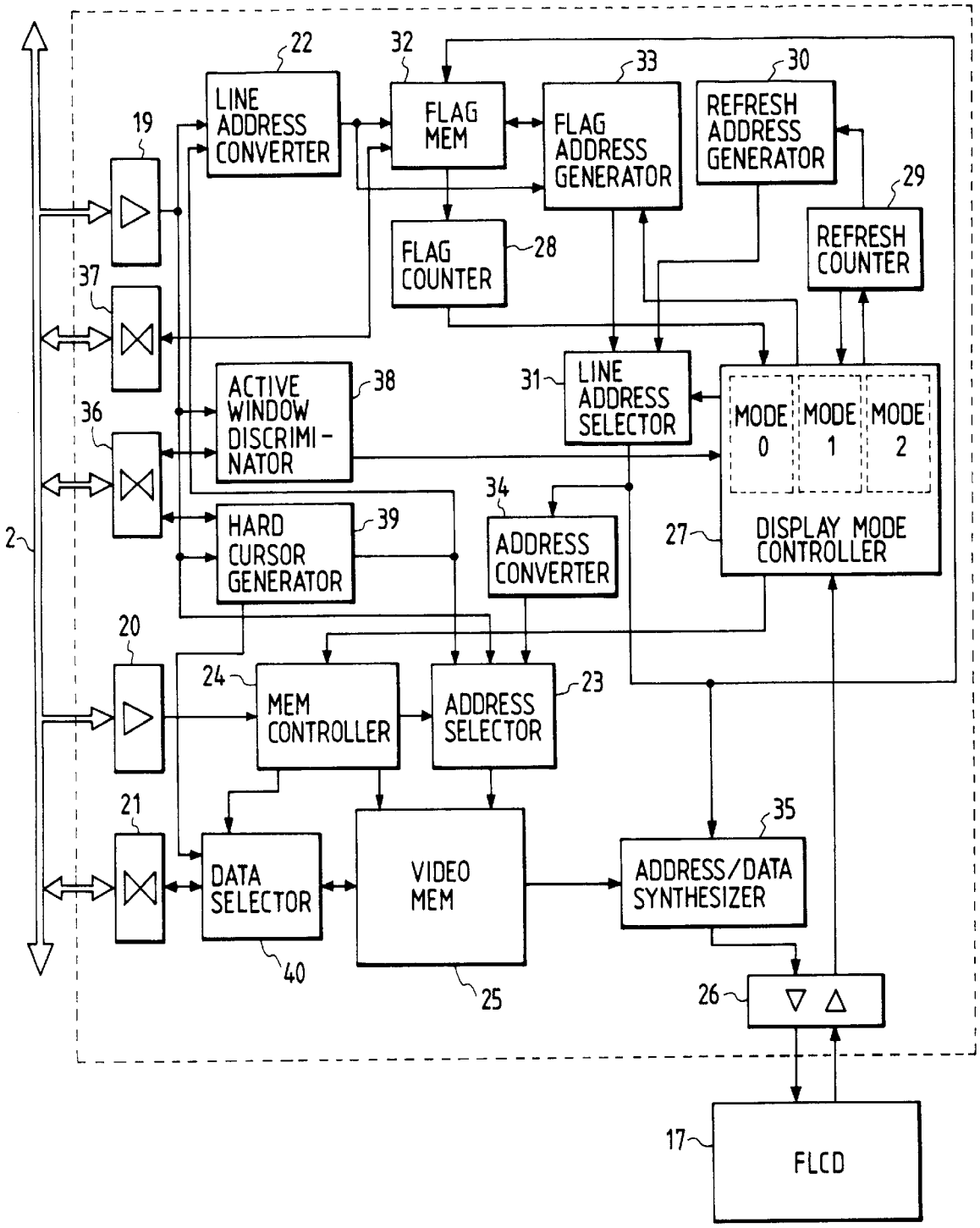
FIG. 2 is a block diagram showing an FLCD interface arrangement according to the embodiment shown in FIG. 1.

FIG. 2 is a block diagram showing an arrangement of the FLCD I/F 18 as an embodiment of the display control apparatus according to the present invention.

Referring to FIG. 2, the FLCD I/F 18 includes an address bus driver 19, a control bus driver 20, and data bus drivers 21, 36, and 37. An address from the CPU 1 is supplied to a line address converter 22, an address selector 23, an active window discriminator 38, and a hard cursor generator 39 through the address bus driver 19.

A control signal from the CPU 1 is supplied to a memory controller 24 through the control bus driver 20. The memory controller 24 generates a control signal for the address selector 23, a control signal for a data selector 40, and a control signal for a video memory 25 (to be described in detail later). The address selector 23 selects one of the three addresses supplied to an input section of the address selector 23 on the basis of the control signal from the memory controller 24 and supplies the selected address to the video memory 25.

The hard cursor generator 39 generates a cursor on the display screen of the FLCD 17 at a position pointed with the mouse 15 serving as the pointing device. Cursor position data is input from the CPU 1 to the hard cursor generator 39 through the data bus driver 36, the hard cursor generator 39 supplies data representing a cursor shape such as an arrow to the data selector 40. At the same time, the hard cursor generator 39 supplies the address for the video memory 25 to the address selector 23 and the line address converter 22. The memory controller 24 switches between the address selector 23 and the data selector 40 in accordance with the control signal from the hard cursor generator 39, thereby selectively supplying the signal from the hard cursor generator 39 to the video memory 25.

The video memory 25 stores display data, comprises a dual-port DRAM (dynamic RAM), and reads out or writes data through the data bus driver 21. The display data written in the data bus driver 21 is transferred to the FLCD 17 through a driver receiver 26 and is displayed on the FLCD 17. The driver receiver 26 supplies a sync signal from the FLCD 17 to a display mode controller 27. The display mode controller 27 determines the number of partial rewrite operations in accordance with information from a flag counter 28 every time a total refresh operation of one frame is completed.

The total refresh operation is to update the entire display screen in a predetermined order. Data is read out from the video memory 25 in this order and is transferred to the FLCD 17. A partial rewrite operation is to preferentially update the display content of a portion, the display content of which is updated by the CPU. The partial rewrite operation is an interrupt operation between frames refreshed in the predetermined order. A relationship between the total refresh and partial rewrite operations will be described in detail later.

In a total refresh operation, the display mode controller 27 supplies a control signal to a refresh counter 29 to increment the count. A counter value from the refresh counter 29 is supplied to a refresh address generator 30 and is converted into a line address for actually refreshing the frame (screen). The line address is input to one input section of a line address counter 31. At this time, the line address counter 31 selects and outputs the line address from the refresh address generator 30 in accordance with the control signal from the display mode controller 27. When the refresh counter 29 performs a count-up operation by one frame, the refresh counter 29 informs this to the display mode controller 27. The display mode controller 27 determines the number of partial rewrite operations in accordance with a mode selected by the information from the active window discriminator 38 upon reception of this information with reference to the counter value from the flag counter 28. Alternatively, every time a partial rewrite operation is executed, the counter value from the flag counter 28 is referred to execute partial rewrite operations a predetermined number of times; or when the counter value becomes "0", a total refresh operation of one frame is executed.

If write or read access of the video memory 25 or the hard cursor generator 39 from the CPU 1 is requested, the line address converter 22 detects write access in the display area from all the kinds of access. The line address converter 22 converts an address into a display line address which is then supplied to the flag memory 32. The flag memory 32 has a storage capacity corresponding to the display line address and represents a flag for determining whether this line address represents a line candidate to be partially rewritten and displayed. For example, in the flag memory 32, a storage location corresponding to the write access in the display area, i.e., the line address corresponding to the change in display content, is set at "1". This indicates a partial rewrite candidate. The flag memory 32 monitors a line address from the line address 31 to set a storage location corresponding to the line address output to the FLCD 17 to "0". This indicates that a total refresh or partial rewrite operation is performed to output the line address to the FLCD 17 to change the display state. In other words, this indicates that the candidate is not the partial rewrite candidate. In this manner, in the flag memory 32, a flag is set at the line address corresponding to the data write access. When data of this line is output, the flag is reset. In contrast to this, when the flag is set (i.e., a change from 0 to 1) in the flag memory 32, the flag counter 28 performs a count-up operation; and when the flag is reset (i.e., a change from 1 to 0) in the flag memory 32, the flag counter 28 performs a count-down operation, thereby representing the number of flags set in the flag memory 32. Any other means may be proposed. However, to cause the flag counter 28 to count the number of flags set in the flag memory 32 is to indicate a necessary degree of partial rewriting. The output from the flag counter 28 is supplied to the display mode controller 27.

A flag address generator 33 refers to the flag memory 32 to detect the set flag, i.e., determine the line address subjected to the partial rewrite operation, and supplies the detection result to one input section of the line address selector 31. To perform a partial rewrite operation, the line address connected to the flag address generator 33 in the line address selector 31 is selected and output under the control of the display mode controller 27.

Figure 3:
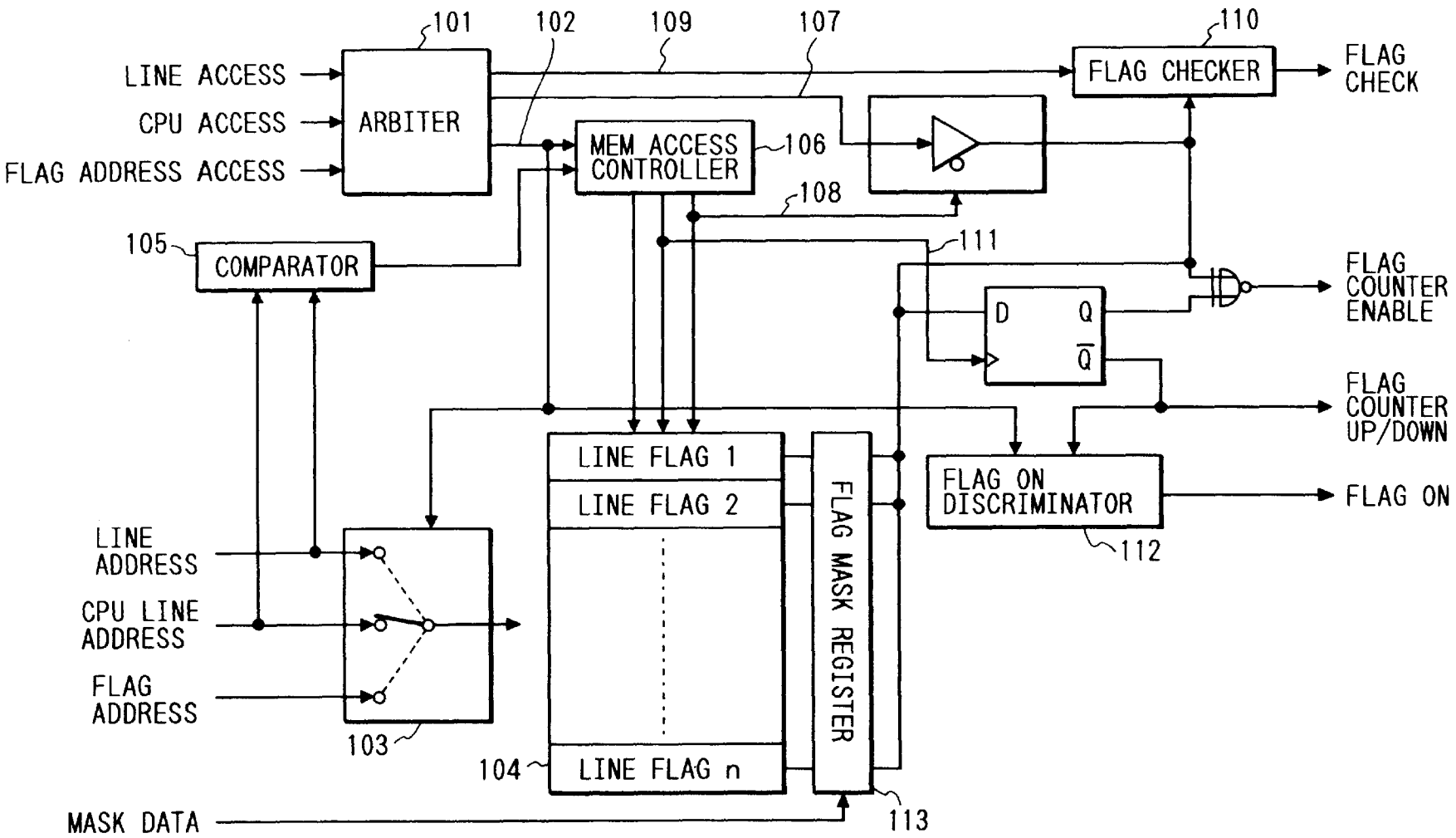
FIG. 3 is a block diagram showing an arrangement of a flag memory.
Figure 4:
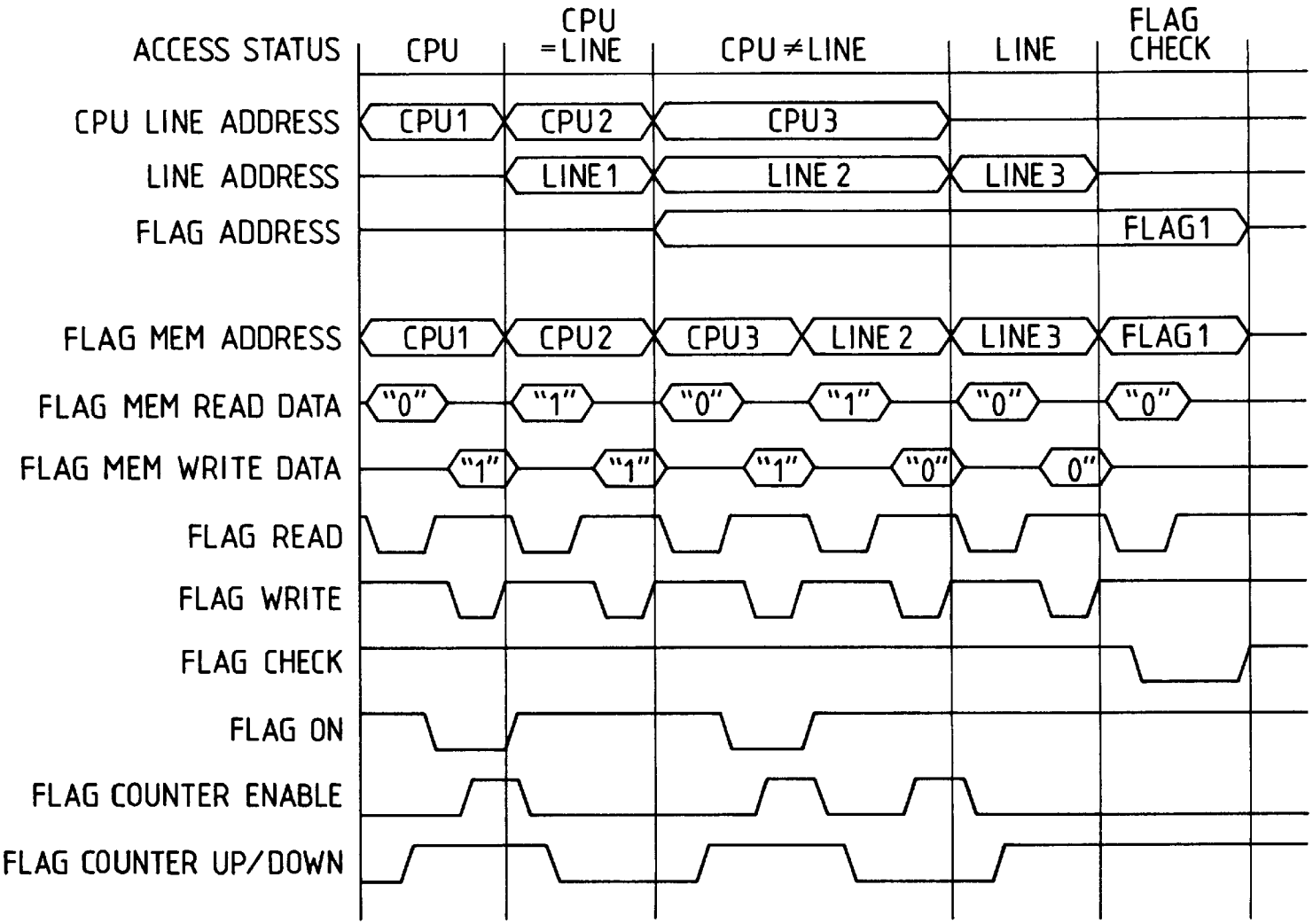
FIG. 4 is a timing chart in the arrangement of the flag memory.

An arrangement of the flag memory 32 is shown in FIG. 3. A selector 103 in the flag memory 32 receives a line address from the line address selector 31, which address is output to the FLCD 17, CPU line addresses as a write address from the CPU 1 and a write address from the hard cursor generator 39, and a flag address from the flag address generator 33. An arbiter 101 arbitrates these three kinds of access operations. An access kind signal 102 as the result of arbitration is applied to the selector 103. An output from the selector 103 is applied as a flag memory address of a memory 104. A priority order is determined in an order of CPU access (VRAM rewrite cycle), line access (refresh cycle), and flag address cycle (partial rewrite cycle), and access timings of the flag memory 32 are shown in FIG. 4.

In CPU access, a CPU line address is selected by the selector 103 and is applied to the memory 104. A line subjected to rewriting is detected by a memory access controller 106 in accordance with the access kind signal 102 and a comparison result from a comparator 105 for comparing the CPU line address and the line address. That is, first of all, the flag is loaded (flag memory read data) and is then read out, and flag data which determines a CPU/line signal 107 is written in the memory 104 (flag memory write data). The CPU/line signal 107 is determined by the arbiter 101 in accordance with whether the access is CPU access or line access. The CPU/line signal 107 is gated and output in accordance with a flag write signal from the memory access controller 106, thereby obtaining flag data. In this embodiment, CPU/line signal 107="1" for CPU access; and CPU/line signal 107="0" for line access.

In line access, the line address is selected by the selector 103 and is applied to the memory 104. The same operation as in CPU access is performed. The line access is different from the CPU access in that flag corresponding to the line output to the FLCD 17 is reset ("0"). When CPU access contends with line access, CPU access is preferentially performed to process only the flag of the CPU access in a coincidence between the CPU line address and the line address, as indicated in the access state of CPU=line in the timings of FIG. 4. However, when the CPU line address does not coincide with the line address, the CPU access is preferentially performed to process the flag, and the flag corresponding to the line access is then processed, as indicated in the access state of CPU≠line is the timings of FIG. 4. The flag processing operations in the CPU access and line access are the same as those in either CPU access or line access. As described above, the flag is preferentially set in CPU access, and the order of line access is lowered to reset the flag. When CPU access contends with line access, a flag is always set for CPU access to properly reset the flag for the line output to the FLCD 17.

Figure 5:
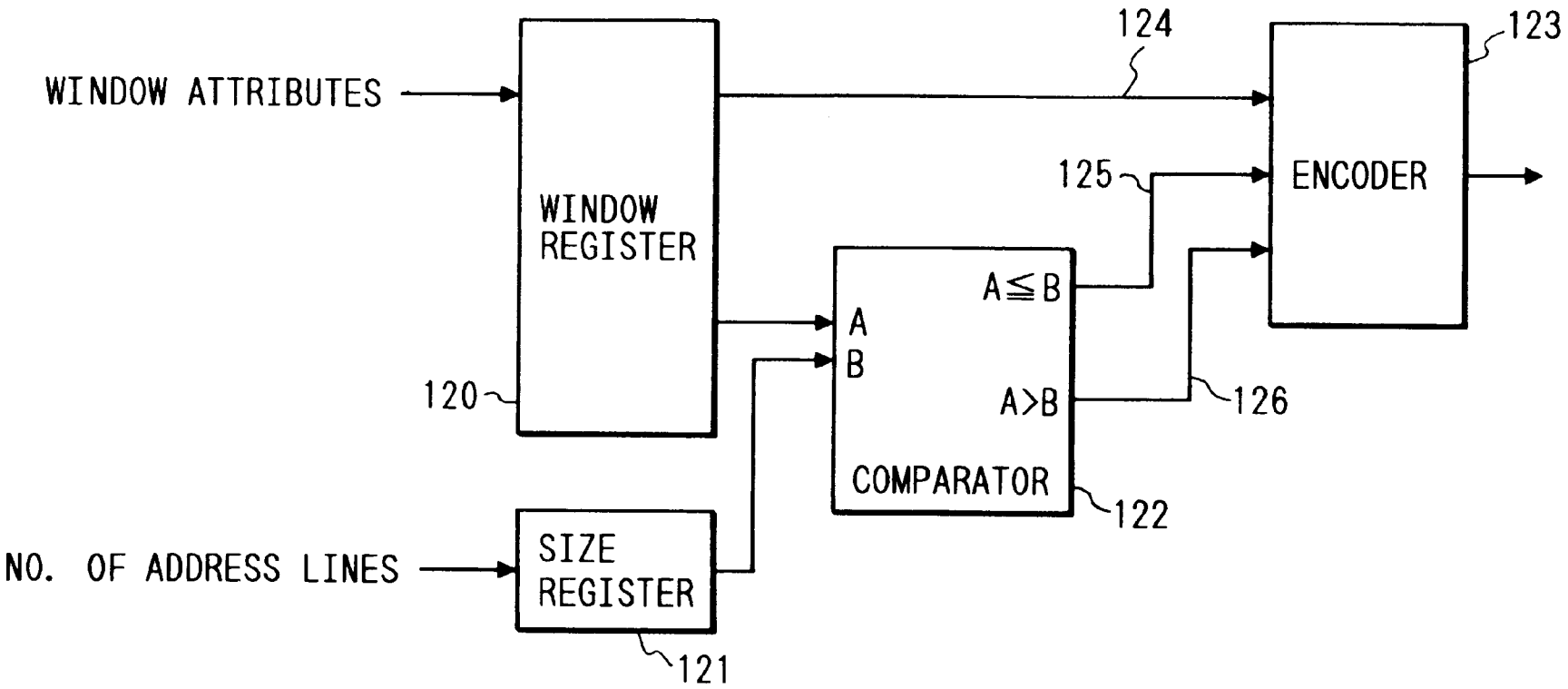
FIG. 5 is a block diagram showing an arrangement of an active window discriminator.

In flag address access, a flag address is selected by the selector 103 and is applied to the memory 104. The memory access controller 106 controls to only load the flag in the memory 104 but not to write data in the memory 104. When the flag address access contends with any other access, flag access flag processing is finally performed, as indicated by the access conditions of CPU≠line and the flag. In this embodiment, the flag counter 28 is constituted by a general up/down counter, monitors updating of data supplied to the flag memory 32, and counts the number of flags stored in the flag memory 32. As previously described above, in the timings (FIG. 4) of the flag memory 32, in CPU access, the memory access controller 106 reads out the flag from the memory 104 from the beginning, and the readout flag data is latched by a D-FF in response to a flag read signal 111. A negative logic output of the latch data is supplied as an up/down signal for the flag counter 28. The latch data and the flag data are exclusively logically ORed to discriminate a coincidence or noncoincidence. If the coincidence is established, the flag data is not updated, and the flag counter is not operated. However, when the noncoincidence is established, since the flag data has been updated, the flag counter is operated. In this embodiment, a negative logic signal of the exclusive OR signal is output as a flag counter enable signal. The flag counter 28 is controlled by the up/down signal, the flag counter enable signal, and the flag write signal 108. This also applies to line access. A flag mask register 113 is a register used when a partial rewrite operation is performed in a specific area such as a window on the display screen. The flag mask register 113 has a one-bit capacity corresponding to the line flag in the memory 104. When one or more windows are open on the display screen of the FLCD 17, the active window discriminator 38 discriminates an active window. The address line of the active window is calculated with software (mask data) by the CPU 1, and the flag mask register 113 of the corresponding line flag is set through the data bus driver 37. FIG. 5 shows an arrangement of the active window discriminator 38. The active window discriminator 38 comprises a register 120 for storing a window attribute, as shown in FIG. 5. An arrangement of the window register 120 is shown in FIG. 18.

Figure 18:
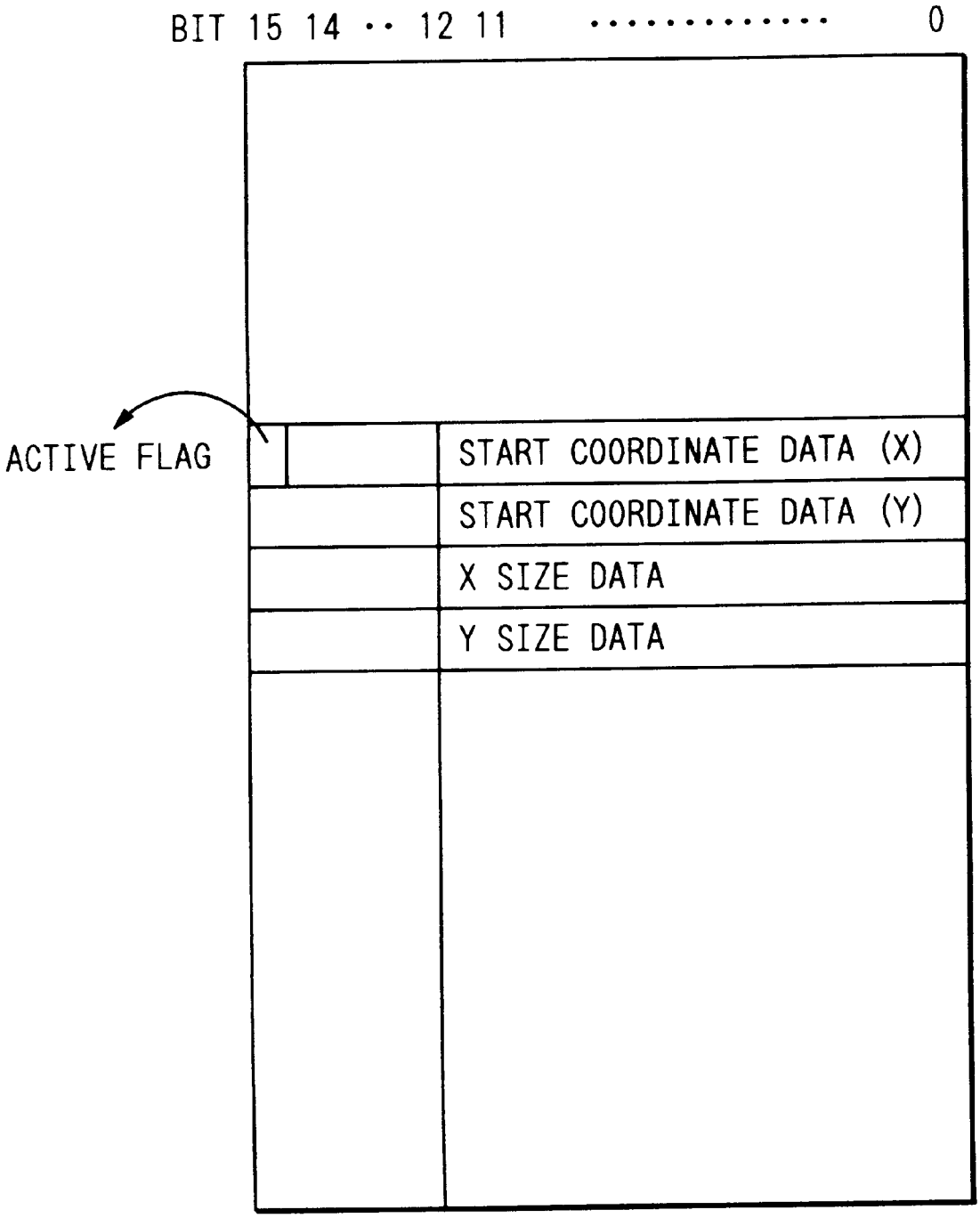
FIG. 18 is a view illustrating a window register.

Start coordinate data in FIG. 18 represents the upper left coordinate point of the corresponding window, X size data represents the size of the corresponding window in the direction of height, and Y size data represents the size of the corresponding window in the direction of width. An active flag is a flag representing that the corresponding window is selected as a real working area. These data are set in registers open for each window. Of these data, the address line of the window can be calculated in accordance with the start coordinate data and the X size data. For example, "1" is set in the flag mask register 113 for a line flag to be masked, and "0" is set in the flag mask register 113 corresponding to the line flag subjected to partial rewriting. When output data and the line flag of the memory 104 are logically ANDed, the line flag can be masked.

The active window discriminator 38 generates a mode select signal for selecting one of the plurality of modes in the display mode controller 27 (to be described later). In this embodiment, one of the three modes is selected. The number of address lines which serves as a threshold value for mode selection is set in a size register 121 in advance. When no window is open and an active flag is not set in the window register 120, a signal line 124 is set at "1". When one or more windows are open, the X size data of each window corresponding to the set active flag and a value (to be referred to as S hereinafter) set in the size register 121 are compared in a comparator 122. If the X size data is S or less, a signal line 125 is set at "1". However, when the X size data is larger than S, a signal line 156 is set at "1". This result is encoded by an encoder 123, and the encoded signal is input to the display mode controller 27.

In this embodiment, only one size register 121 is used to set the threshold value. However, a plurality of size registers 121 are arranged to increase the number of modes in the display mode controller 27, thereby obtaining display states finely corresponding to sizes of the windows.

Figure 6:
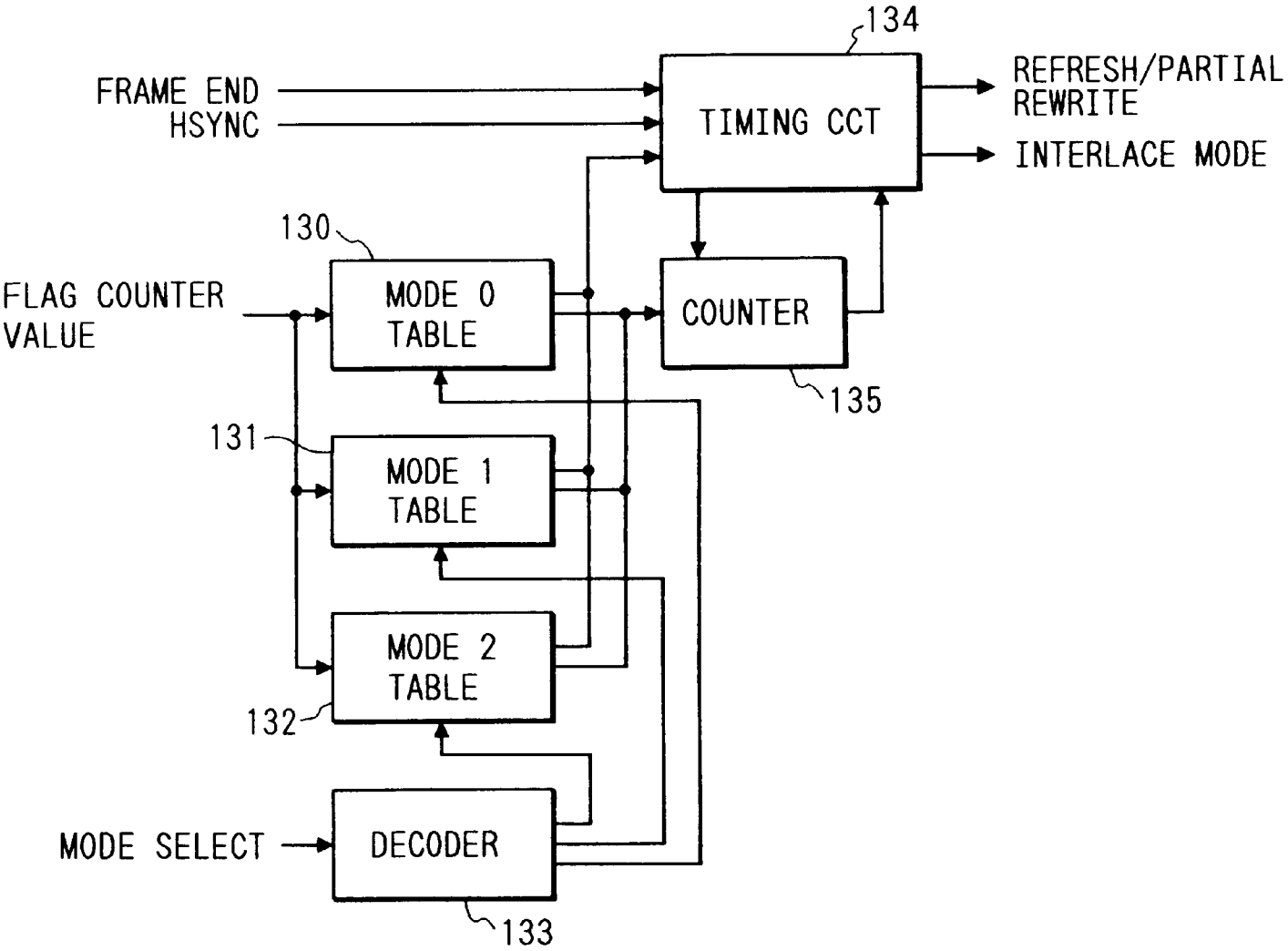
FIG. 6 is a block diagram showing an arrangement of a display mode controller.

FIG. 6 shows an arrangement for realizing the display mode controller 27. Referring to FIG. 6, a frame end is a signal for causing the refresh counter 29 to signal the end of a frame. HSYNC is a data request signal from the FLCD 17. A flag counter value is a counter value from the flag counter 28. A mode select signal is input to the active window discriminator 38 and decoded by a decoder 133. The decoded signal selects one of a mode 0 table 130, a mode 1 table 131, and a mode 2 table 132. The mode 0 table 130, the mode 1 table 131, and the mode 2 table 132 are shown in FIG. 19.

A flag counter value is converted into the corresponding number of partial rewrite operations by the mode 0 table 130, the mode 1 table 131, or the mode 2 table 132. For example, when no window is open, the mode 0 table 130 is selected. If the flag counter value is "0", any partial rewrite operation need not be performed, and the partial rewrite operation is not performed. When the flag counter value is a value falling within the range of 1 to 50, the number of partial rewrite operations is determined in proportion to the flag counter value, and partial rewrite operations of all the lines requiring partial rewriting are performed. The rewritten lines are then output. When the flag counter value is 51 or more, the number of partial rewrite operations is increased, and a refresh rate becomes low. Therefore, the maximum number of partial rewrite operations is limited to 20. When the open window is small and the mode 1 is selected, all the rewritten lines are defined as partial rewrite objects. However, when the open window is large, and partial rewriting of all the lines cannot cope with the display speed, partial rewriting is performed in accordance with the value of the size register 121 in which the number of lines subjected to partial rewrite operations is preset as in the mode 2. With this control, the partial rewrite function as the feature of the FLC is effectively utilized to obtain high-quality display contents. A timing circuit 134 determines the end of frame or a display mode every HSYNC. When the number of partial rewrite operations is not zero at the end of one frame, the timing circuit 134 sets the partial rewrite mode of a refresh/partial rewrite signal. At the same time, the timing circuit 134 supplies a load signal to a counter 135 to load the number of partial rewrite operations from the mode 0 table 130, the mode 1 table 131, or the mode 2 table 132. The counter is operated every HSYNC. When a signal representing the end of loading is output from the counter, the refresh/partial rewrite signal is set to the refresh mode. Thereafter, this state is continued until the end of refreshing of one frame.

A refresh interlace mode may be changed depending on a flag counter value. In this case, a signal representing a change in refresh interlace mode is sent from the mode 0 table 130, the mode 1 table 131, or the mode 2 table 132 to the timing circuit 134. An interlace mode designation signal is output from the timing circuit 134.

A total refresh method may be a non-interlace method for continuously updating lines from the uppermost line downward, a two-line interlace method for interlacing every other line as in a CRT or the like, or a random interlace method unique to the FLCD 17. The random interlace method is used to suppress screen flickering, or the non-interlace method is used to continuously update the screen. In this manner, the different interlace methods are selectively used.

Figure 7:
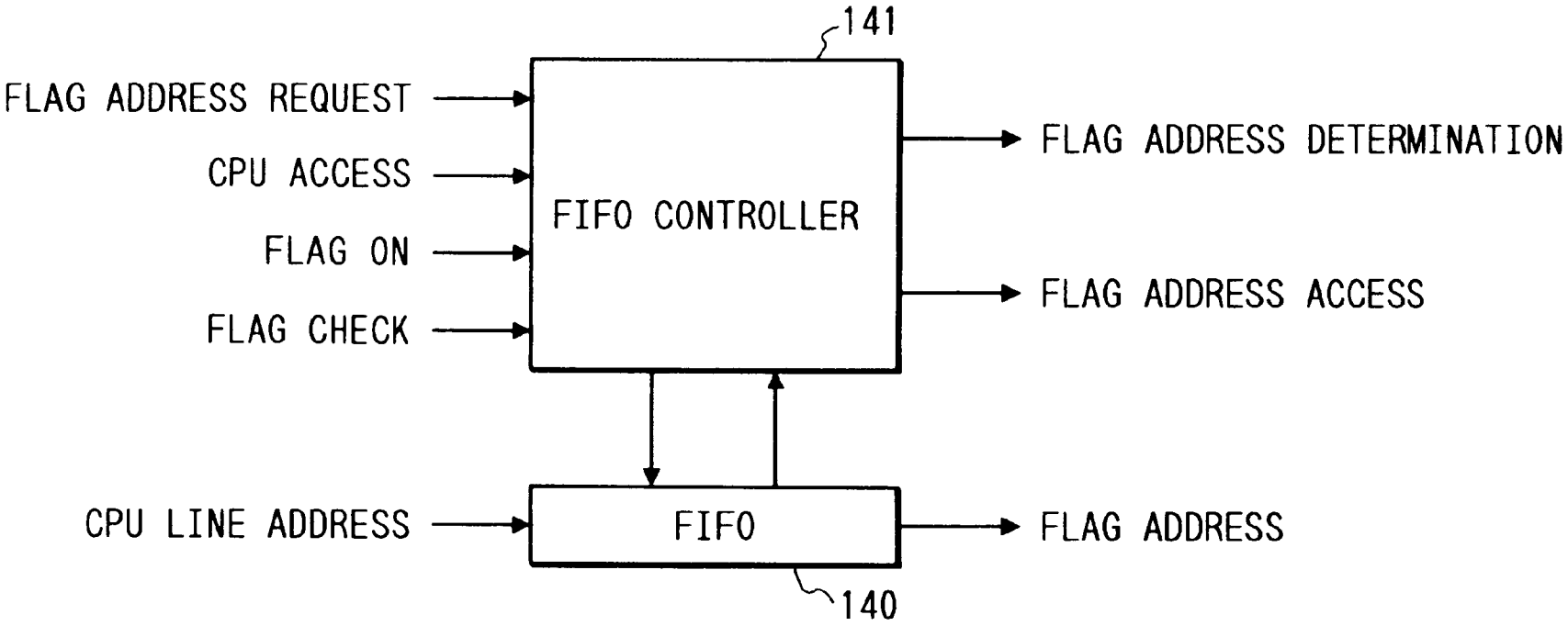
FIG. 7 is a block diagram showing a FIFO arrangement of a flag address generator.
Figure 8:
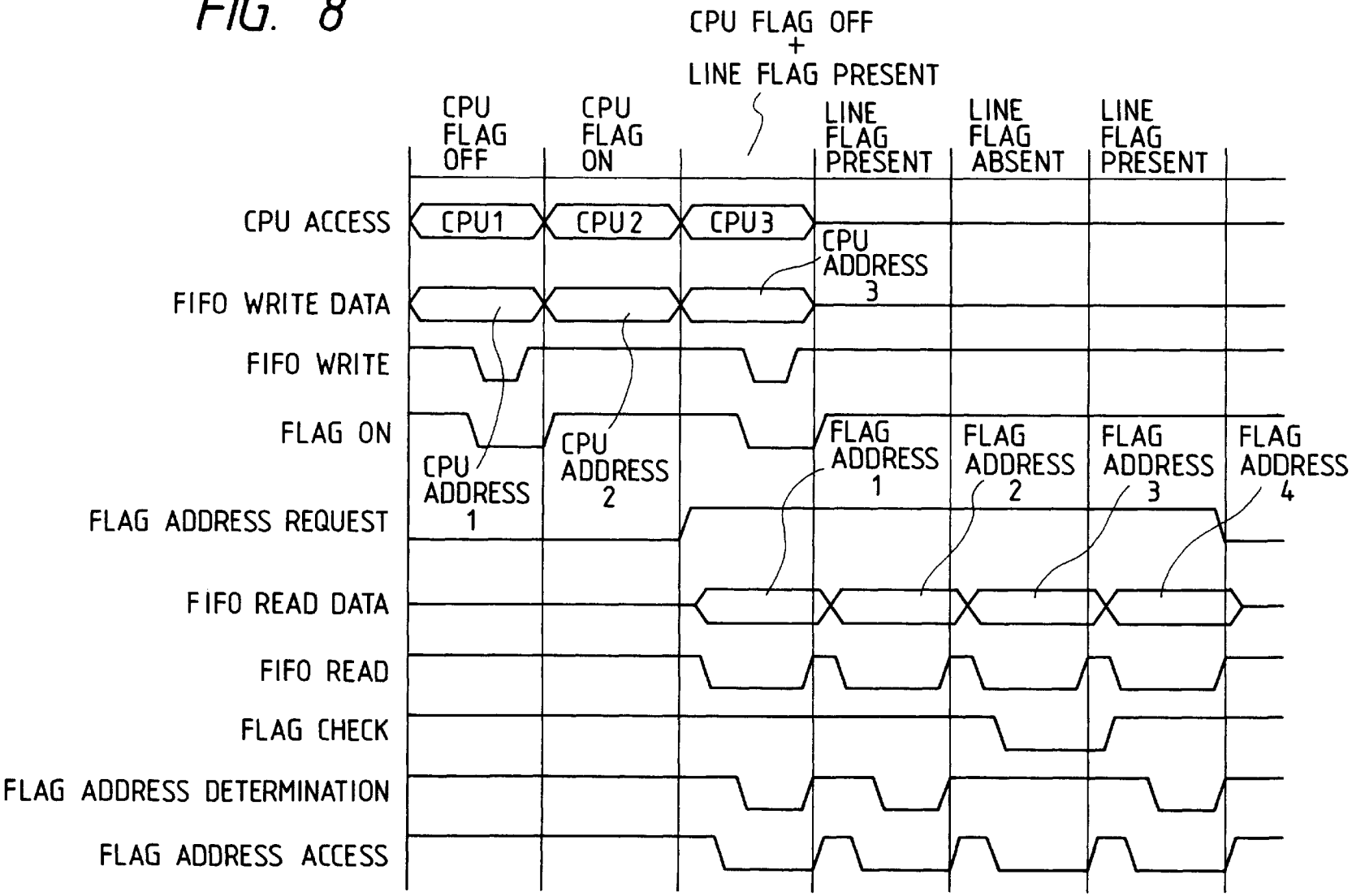
FIG. 8 is a timing chart showing the FIFO arrangement of the flag address generator.

An arrangement of a FIFO flag address generator used as the flag address generator 33 is shown in FIG. 7. Timings of the flag address generator shown in FIG. 7 is shown in FIG. 8. Input data to a FIFO 140 is a CPU line address (FIFO write data) supplied through the line address converter 22, and an output from the FIFO 140 is a flag address (FIFO read data) supplied to the line address selector 31. When CPU access is requested, the CPU line address is input to the FIFO 140 in accordance with the FIFO write signal under the control of a FIFO controller 141. In order to prevent the CPU line address from being input to the FIFO 140 in an overlap manner, a flag ON discriminator 112 in the flag memory 32 generates a flag ON signal in accordance with the access kind signal 102 from the arbiter 101 and the up/down signal. The flag ON signal is set at "1" when the flag is set. When the flag is reset, the flag ON signal is set at "0". When the CPU access is requested and the flag ON signal is already set at "1", the FIFO controller 141 does not input the corresponding line address to the FIFO 140 because this line address has already been input in the FIFO 140. However, when the flag ON signal is set at "0", the FIFO controller 141 inputs the line address to the FIFO 140 because this line address is not yet input to the FIFO 140. In response to a flag address output request from the display mode controller 27, the FIFO controller 141 sequentially generates the line addresses stored in the FIFO 140 as flag addresses in accordance with the FIFO read signal. At this time, a flag address access signal is simultaneously generated by the FIFO controller 141. This flag address access signal is used to arbitrate access in the arbiter 101 in the flag memory 32. When flag address access obtains an access right, a flag address is applied to the memory 104. At this time, a flag check circuit 110 generates a flag check signal on the basis of a flag address cycle signal 109 from the arbiter 101 and the readout flag data to discriminate whether a flag is present. When the readout flag is reset, the flag check signal is set at "0". However, when the readout flag is set, the flag check signal is set at "1". When the flag check signal is set at "0", the FIFO controller 141 discriminates that the line address stored in the FIFO 140 is already output, and a flag address is read out from the FIFO 140 again. If the flag check signal is set at "1", the FIFO controller 141 discriminates that the line address is not yet output. The FIFO controller 141 outputs the flag address and a flag address determination signal.

Upon reception of this flag address determination signal, the display mode controller 27 switches the line address selector 31 to output a flag address as a line address.

Line addresses output from the line address selector 31 by total refresh and partial rewrite operations are input to an address converter 34, an address/data synthesizer 35, and the flag memory 32.

The address converter 34 converts a display line address into an address for the DRAM in the video memory 25. The converted address is selected and output by the address selector 23 in accordance with a data transfer request from the display mode controller 27 to the memory controller 24. At this time, a data transfer cycle is generated by the memory controller 24 in the video memory 25. Data corresponding to the address selected and output by the address selector 23 is read out from the DRAM and is supplied to the address/data synthesizer 35.

The address/data synthesizer 35 synthesizes the line address from the line address selector 31 and the data from the video memory 25, and the synthesized data is transferred to the FLCD 17 through the driver receiver 26. The data is then displayed on the FLCD 17.

Figure 9:
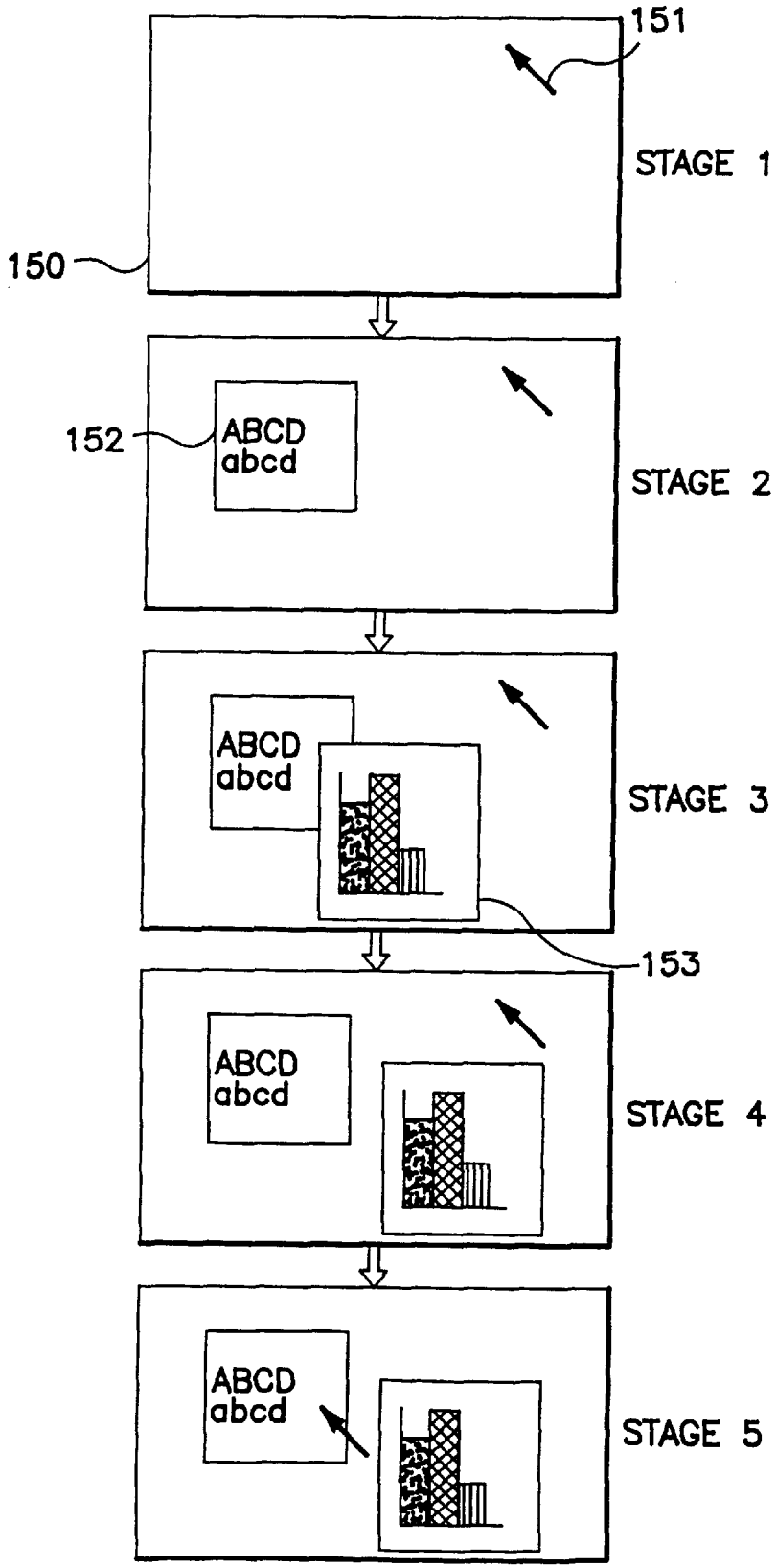
FIG. 9 is a view showing an FLCD display screen for explaining an operation for determining an active window.

A relationship between the total refresh operation and partial rewrite operation will be described below. This relationship will be described in the following stages, as shown in FIG. 9.

Figures 10, 10A:
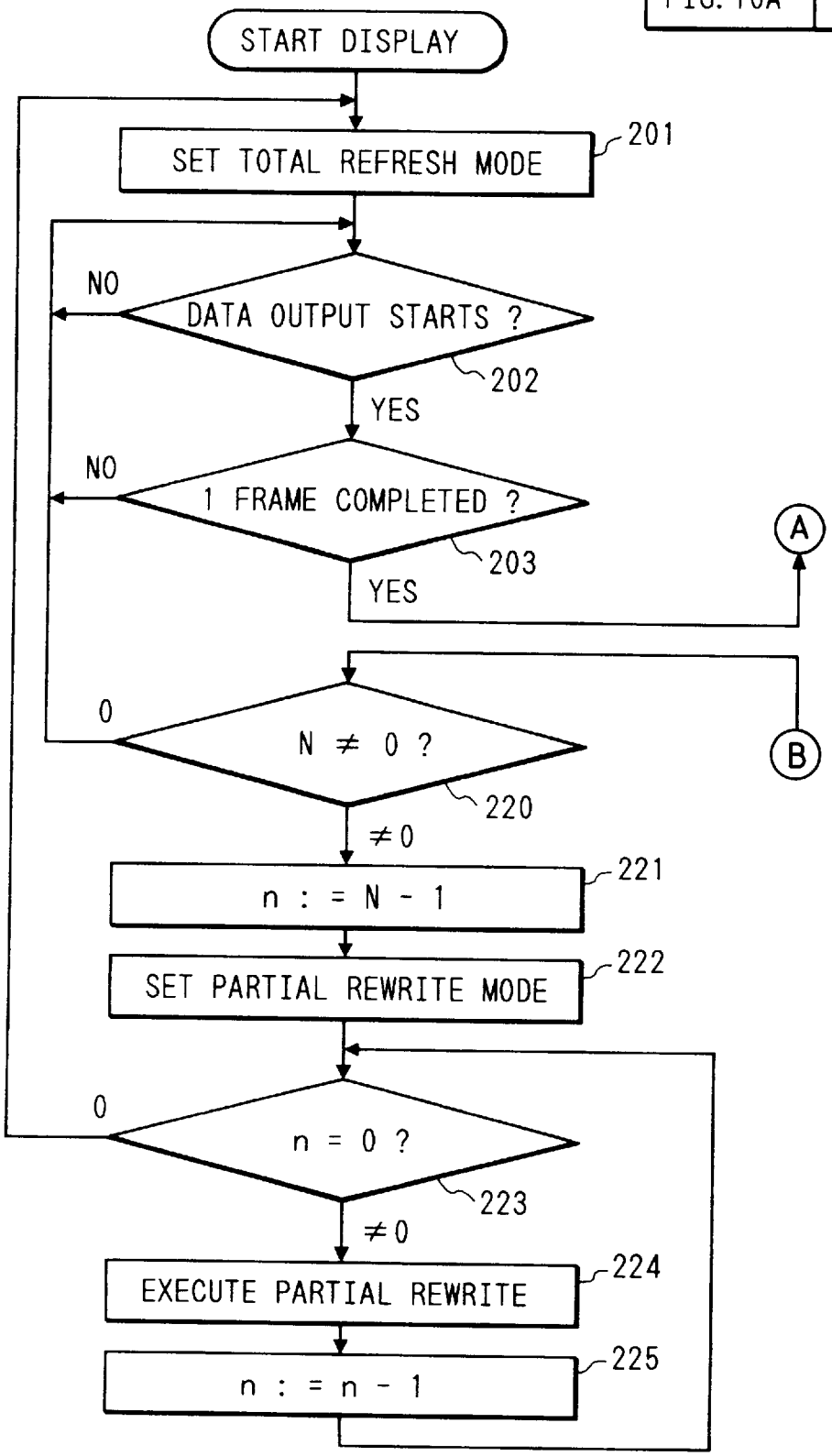
FIGS. 10A and 10B are flow charts for explaining an operation of the FLCD interface.
Figure 10B:
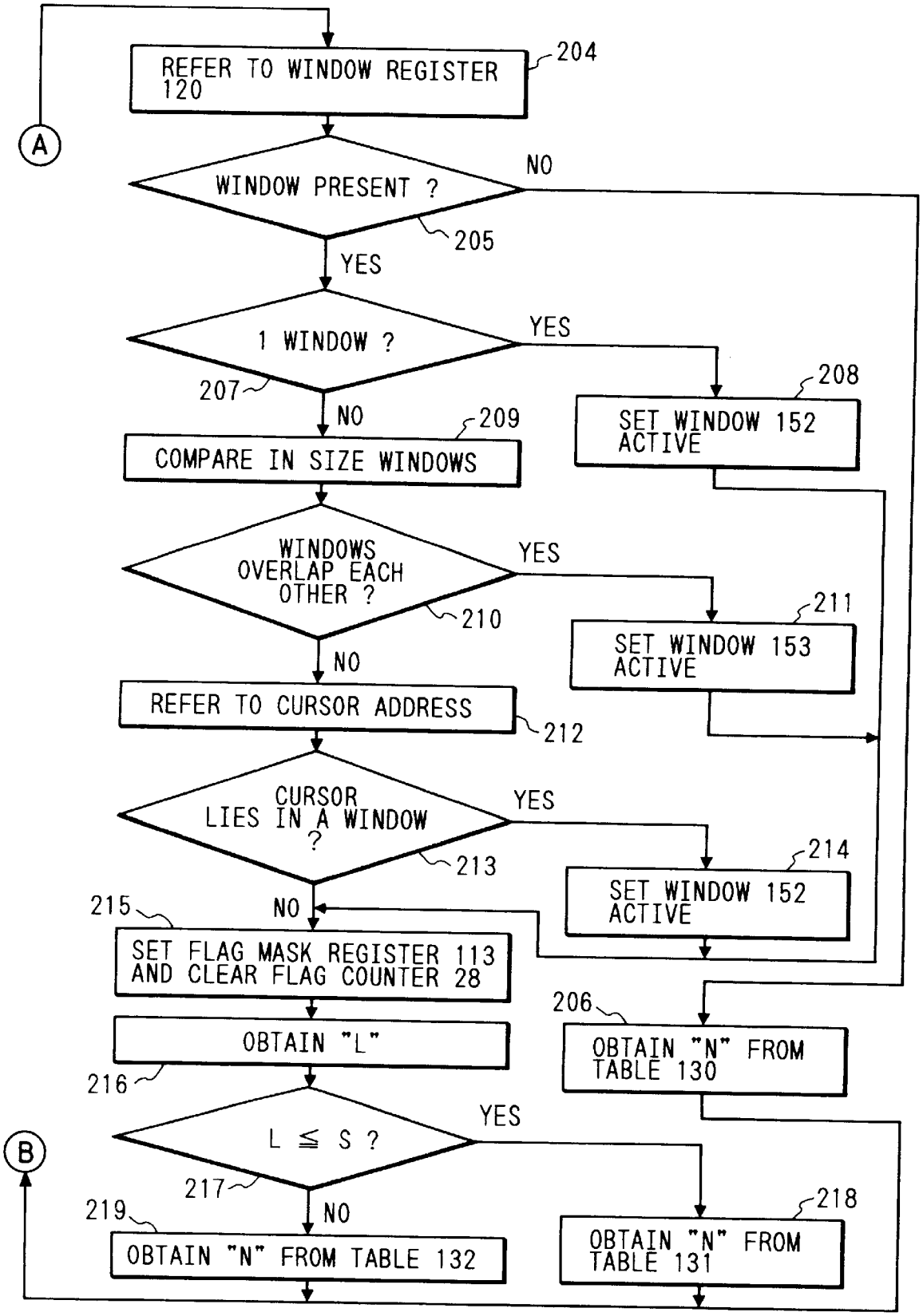

(Stage 1) . . . A state in which a window is not open
(Stage 2) . . . A state in which one window is open
(Stage 3) . . . A state in which two windows are open and overlap
(Stage 4) . . . A state in which two windows are open and separated from each other
(Stage 5) . . . A state in which two windows are open and separated from each other, and a cursor is placed on one window Referring to FIG. 9, the FLCD 17 has a display screen 150, a cursor 151 has a shape of an arrow. The display screen 150 has a first open window 152 and a next open window 153. FIGS. 10A and 10B are flow charts showing a flow for executing total refresh and partial rewrite operations.

When the display is started upon a power-ON operation, a total refresh mode is set in step 201. When start of data supply to the FLCD 17 is confirmed in step 202, the flow advances to step 203 to wait until a total refresh operation of one frame is executed. When the total refresh operation of one frame is completed, the window register 120 is referred in step 204 to discriminate whether a window is open. The subsequent control branches into stage 1 to stage 5, so that control of each stage until the flow advances to step 221 will be described below.

(Stage 1) Since no window is open at this moment, the flow advances to step 206, and a number N of partial rewrite operations is obtained from the flag counter value from the mode 0 table 130 in the display mode controller 27. The flow then advances to step 220.

(Stage 2) Since one window is open, the flow advances from step 207 to step 208, and "1" is set in the active bit corresponding to the window 152 in the window register 120. The flow advances to step 215 to refer to the line address of the active window and set the flag mask register 113 in the flag memory 32 so as to mask lines except for the line corresponding the referred line address. At the same time, the flag counter 28 is cleared. Only the active window is subjected to partial rewriting. In step 216, the number L of lines of the active window is calculated. In step 217, the calculated value is compared with the size value S preset in the size register 121 in the active window controller 38 to discriminate whether the mode 1 table 131 or the mode 2 table 132 in the display mode controller 27 is referred to. In this case, L is smaller than S, and the flow advances to step 218. In step 218, the number N of partial rewrite operations is obtained from the mode 1 table 131 in accordance with a flag counter value, and the flow advances to step 220.

(Stage 3) Since the two windows are open, the flow advances from step 207 to step 209. A degree of overlapping of the windows is calculated by software processing using the data from the window register 120. If the two windows are discriminated to overlap each other in step 210, the flow advances to step 211. Otherwise, the flow advances to step 212. In stage 3, since the two windows overlap each other, the flow advances to step 211, and "1" is set in the active bit corresponding to the window 153 in the window register 120. The flow advances to step 215 to refer to a line address of an active window from the window register 120, and the flag mask register 113 is set in the flag memory 32 so that line flags except for the line flag corresponding to the line address of the active window are masked. At the same time, the flag counter 28 is cleared. The number N of the active window 216 is calculated in step 216. In step 217, the calculated value is compared with the size value S preset in the size register 121. In this case, L is larger than S, and the flow advances to step 219. In step 219, the number N of partial rewrite operation is obtained from the mode 2 table 132 in accordance with the flag counter value.

(Stage 4) Since the two windows are open, the flow advances from step 207 to step 209. In this case, these windows do not overlap each other, and the flow advances from step 210 to step 212. Cursor address information from the hard cursor generator 39 is referred to in step 213 to discriminate that the cursor is present in one of the windows. If YES in step 213, the flow advances to step 214. Otherwise, the flow advances to step 215. In stage 4, since the cursor is not located within any window, setup of the active window is not changed, and the flow advances to step 215. A line address of an active window from the window register 120 is referred to, and the flag register 113 in the flag memory 32 is set such that line flags except for the line flag corresponding to the line address of the active window are masked. At the same time, the flag counter 28 is cleared. In step 216, the number L of lines of the active window is calculated. In step 217, the calculated value is compared with the size value S preset in the size register 121. In this case, the size of the active matrix does not change from that in stage 3, and the flow advances to step 219. If the size of the active window changes, and L is smaller than S, the flow advances to step 218. In step 219, the number N of partial rewrite operations is obtained from the mode 2 table 132 in accordance with the flag counter value, and the flow advances to step 221.

(Stage 5) Since the two windows are open, the flow advances from step 207 to step 209. In addition, these windows do not overlap each other, so that the flow advances from step 210 to step 212. In step 212, cursor address information from the hard cursor generator 39 is referred to. In step S213, since the cursor is present in the window 132, the flow advances to step 214. The window 152 is set as an active window, and "1" is set in the active bit corresponding to the window 152 in the window register 120. The flow advances to step 215 to set the flag mask register 113 in the flag memory 32 so that line flags except for the line flag corresponding to the line address of the active window are masked. At the same time, the flag counter 28 is cleared. In step 216, the number L of lines of the active window is calculated. In step 217, the calculated value is compared with the size value S preset in the size register 121. In this case, L is smaller than S, and the flow advances to step 218. In step 218, the number N of partial rewrite operations is obtained from the mode 1 table 131 in accordance with the flag counter value.

In this embodiment, two windows are open. However, a description will be similarly made when three or more windows are open. That is, the number of windows is not limited to two.

In step 220, the number N of partial rewrite operations is discriminated to be "0" or not. If not "0" in step 220, N−1 is substituted in a control variable n. This operation corresponds to loading in the counter 135. In step 222, the partial rewrite mode is set. It is then discriminated in step 223 whether n=0. That is, it is discriminated whether the partial rewrite operations are performed by the preset number of times. If the partial rewrite operations are not completed by the preset number of times in step 223, the flow advances to step 224. Partial rewrite operations are performed. In step 225, n−1 is substituted into n, and the flow advances to step 223. When it is discriminated that the partial rewrite operations are completed by the preset number of times, the flow returns to the first step 201 to set a total refresh mode again and wait for the next output.

Figure 11:
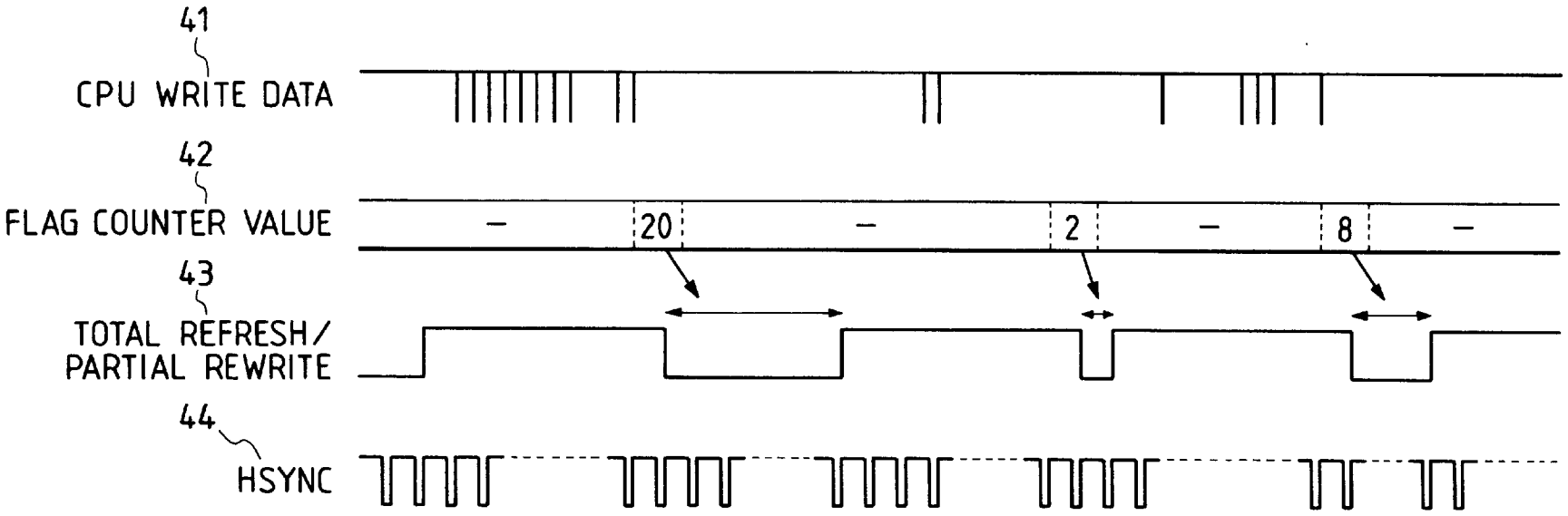
FIG. 11 is a timing chart for explaining a partial rewrite/refresh operation of the FLCD interface.

FIG. 11 shows the relationship between the total refresh and partial rewrite operations.

In this case, CPU write data 41 is written by the CPU 1 in a display region of the video memory 25 through the address driver 19. Data updating is frequently performed in an area where lines are dense. A change in display content is less frequent in an area where lines are sparse.

A flag counter value 42 is a value represented by the flag counter 28. When a change in contents of the memory is requested, the flag counter line 42 represents the number of updated lines. Even if the counter is counted up by the CPU write data 41, the counter counts down a total refresh output. For this reason, the flag counter value 42 at the end of total refresh mode of one frame represents the number of lines rewritten by the CPU 1 after the total refresh data of this frame are output.

A total refresh/partial rewrite signal 43 is set at "1" for the total refresh cycle and "0" for the partial rewrite cycle.

(Second Embodiment)

In the first embodiment, the means for calculating and setting data in the flag mask register 113 in the flag memory 32 in a software manner using the start coordinate data (X) and the X size data set in the window register 120 in the active window discriminator 38 has been described. In the second embodiment, a means for obtaining data set in a flag mask data 113 by a hardware circuit will be described below.

Figure 12:
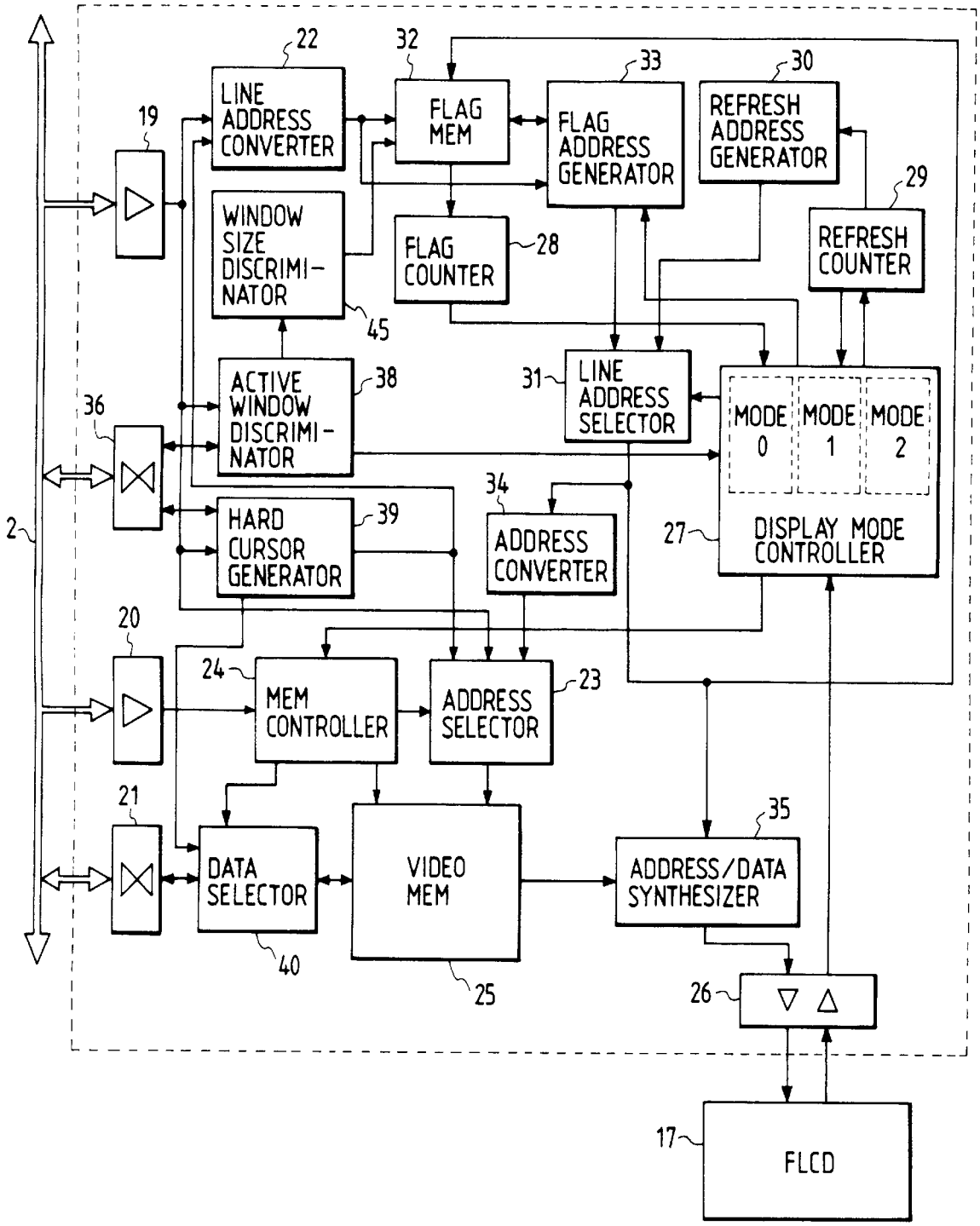
FIG. 12 is a block diagram showing an arrangement of an FLCD interface according to the second embodiment of the present invention.
Figure 13:
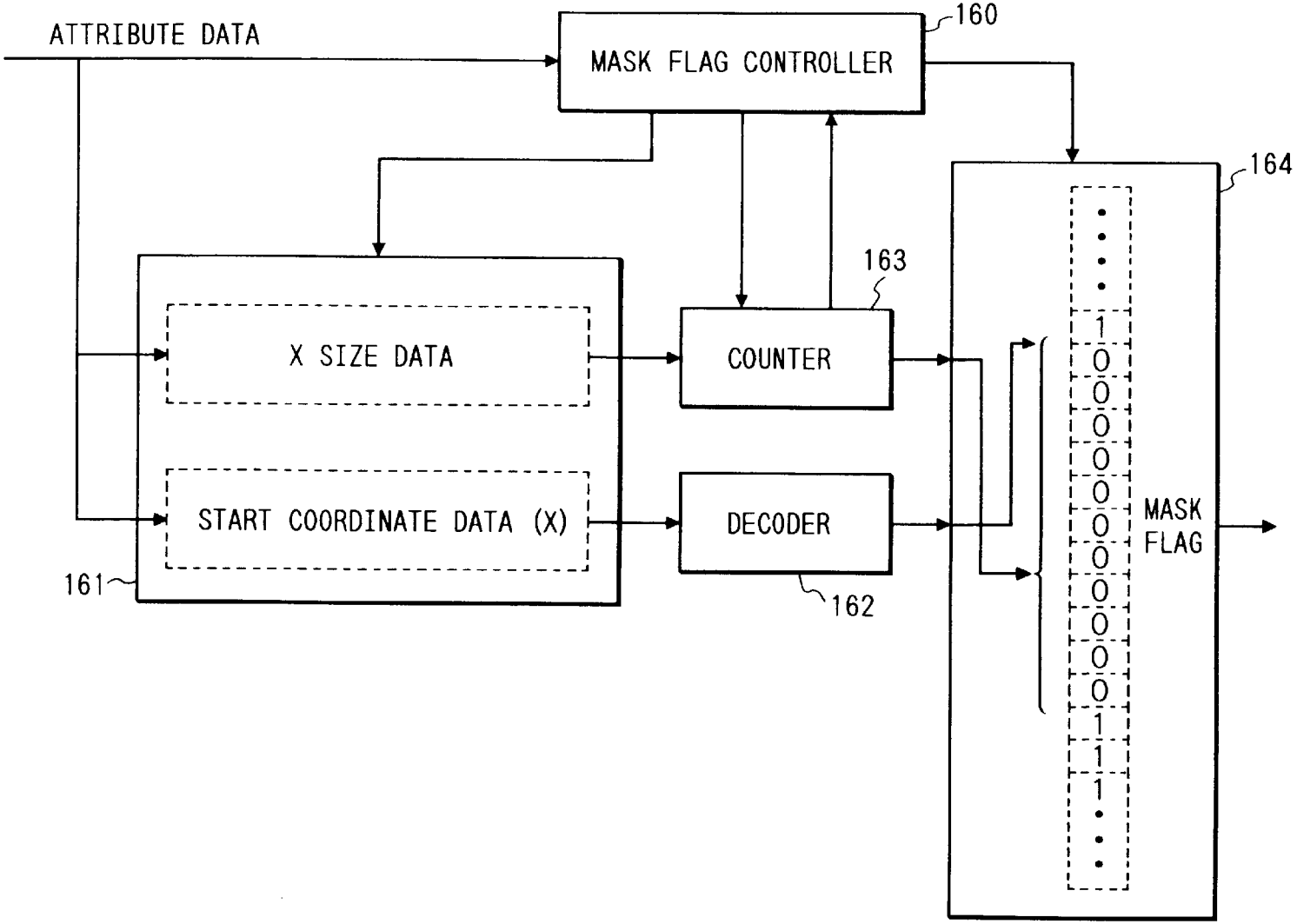
FIG. 13 is a block diagram showing an arrangement of a window size discriminator.

FIG. 12 is a detailed block diagram showing the arrangement of an FLCD I/F 18 of this embodiment. The same reference numerals as in FIG. 1 denote the same parts, and a detailed description thereof will be omitted. Referring to FIG. 12, a window size discriminator 45 is a circuit for calculating a line address of an active window in this embodiment. FIG. 13 is a block diagram showing an arrangement of the window size discriminator 45.

When a window attribute is input to the window register 120 of the active window discriminator 38, a mask flag controller 160 discriminates whether an active flag is set. If so, start coordinate data (X) and X size data of this attribute are latched in an attribute memory circuit 161. At the same time, "1" is set in a mask flag 164, and data is set so as to mask all the line flags. The start coordinate data (X) latched by the attribute memory circuit 161 is decoded by a decoder 162 to obtain a start address for canceling the mask data in the mask flag 164. The X size data latched by the attribute memory circuit 161 is loaded in a counter 163 to set mask flags 164 corresponding to the value of the counter 164 from the start address to be zero, thereby preventing the line flag from being masked. The value of the mask flag 164 is input to the flag mask register 113.

The line address of the active window is calculated by the hard circuit, as described above. When the window attribute is input to the window register 120 in the active window discriminator 38, the value of the flag mask register 113 is automatically set without using software.

(Third Embodiment)

The first embodiment exemplifies the means for calculating and setting data representing whether windows overlap each other in accordance with software using the start coordinate data, the X size data, and the Y size data, all of which are set in the window register 120 in the active window discriminator 38, when a plurality of windows are open. In the third embodiment, a means for detecting overlapping of windows by a hard circuit having flags corresponding to the size of the display screen will be described.

Figure 14:
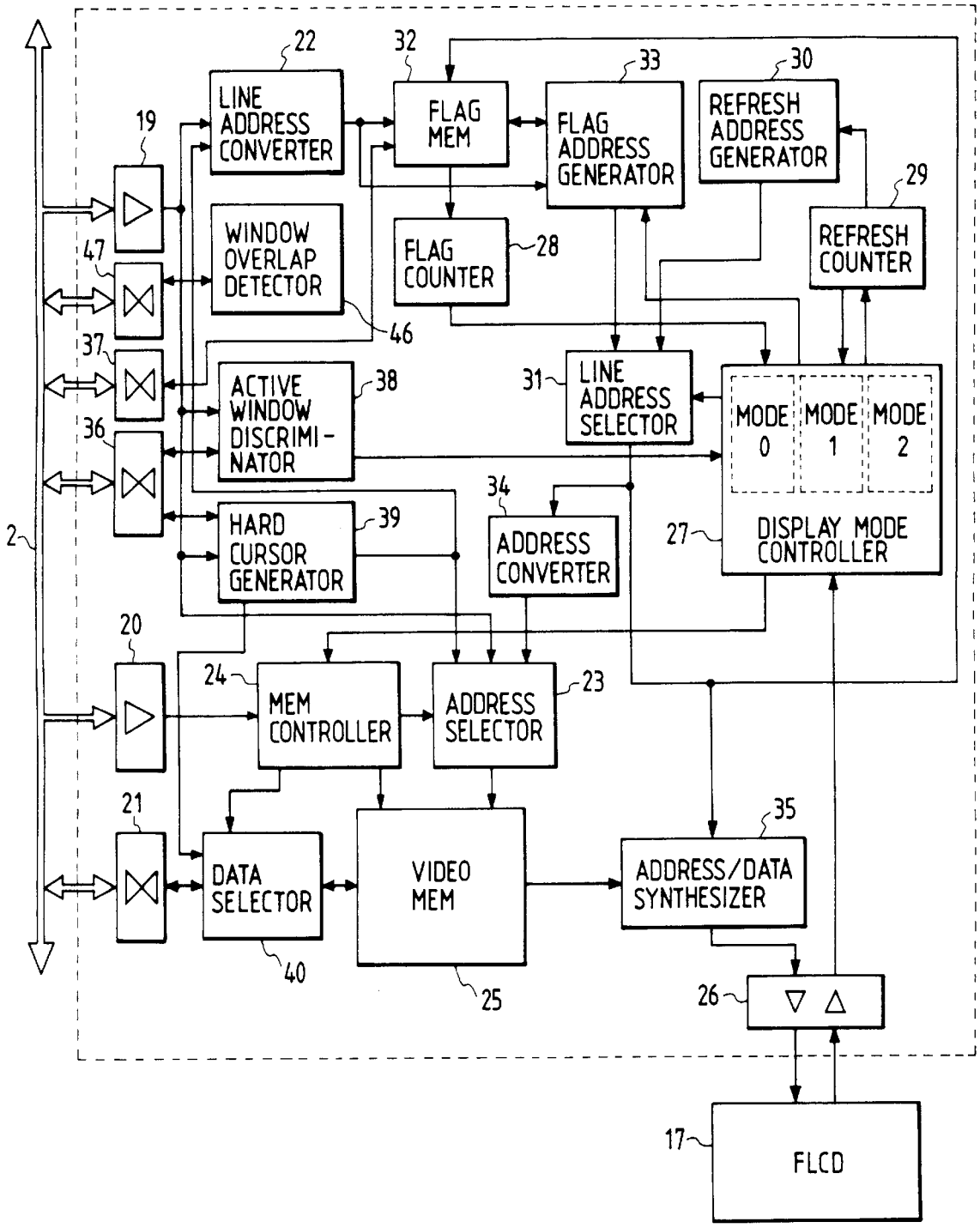
FIG. 14 is a block diagram showing an arrangement of an FLCD interface according to the third embodiment of the present invention.
Figure 15:
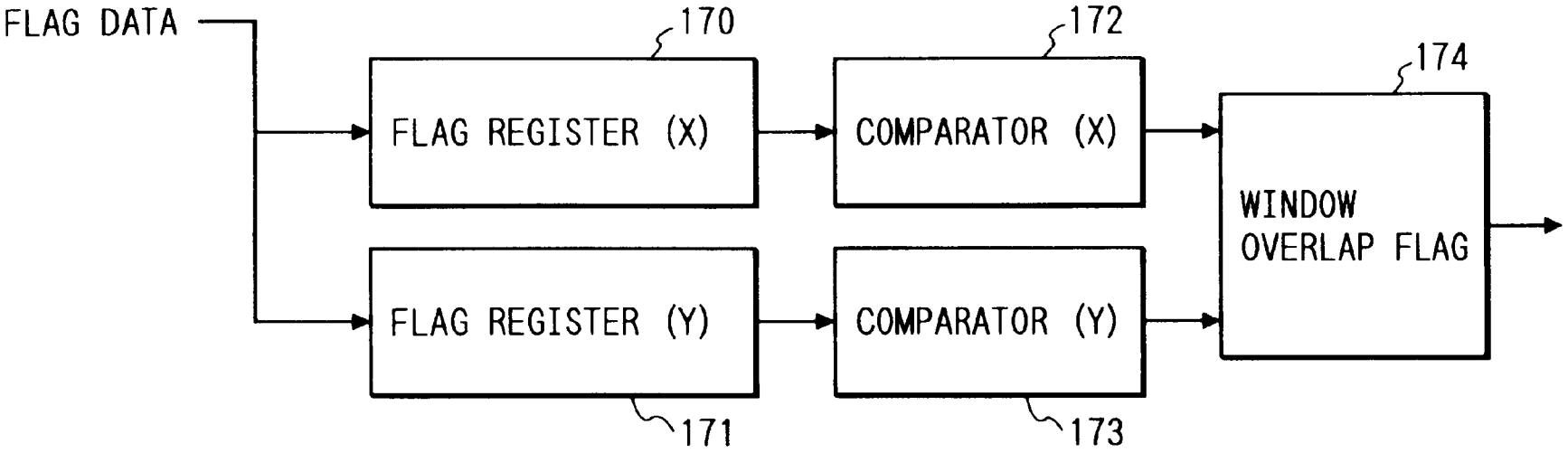
FIG. 15 is a block diagram showing an arrangement of a window overlap detector.

FIG. 14 is a detailed block diagram showing the arrangement of an FLCD I/F 18 of this embodiment. The same reference numerals as in FIG. 1 denote the same parts in FIG. 14, and a detailed description thereof will be omitted. Referring to FIG. 14, a window overlap detector 46 is a circuit for detecting overlapping of windows in this embodiment. FIG. 15 is a block diagram showing an arrangement of the window overlap detector 46.

Figure 16:
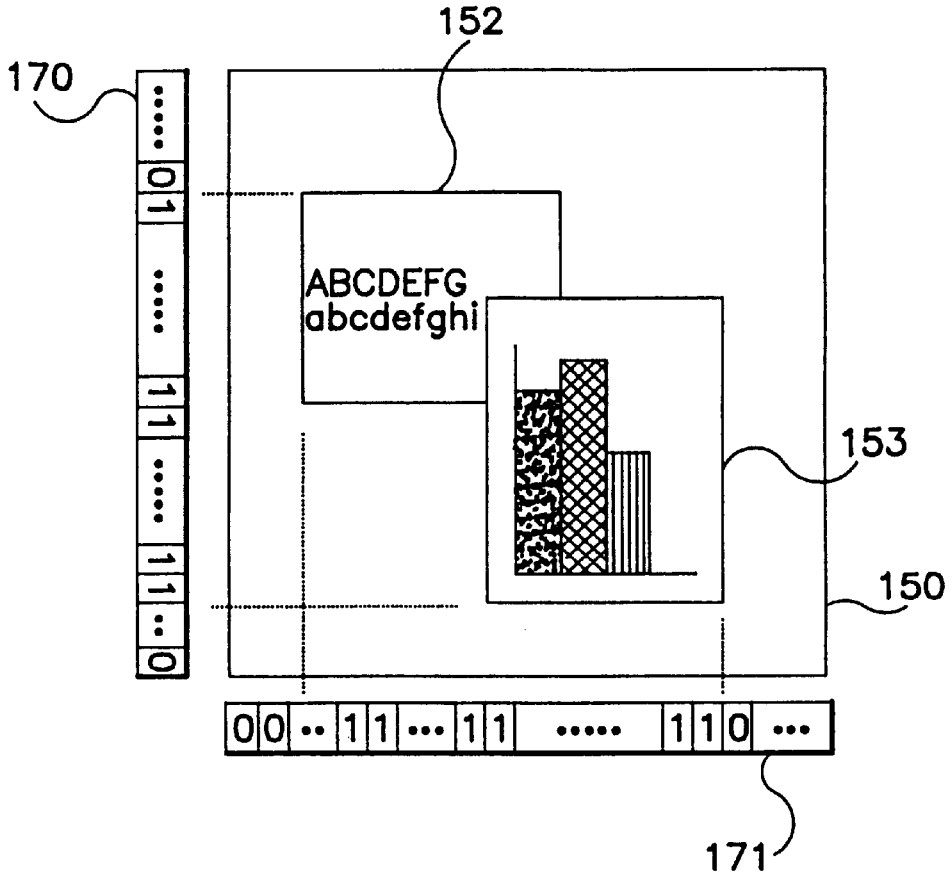
FIG. 16 is a view showing a correspondence between the display screen of an FLCD 17 and flag registers (X) and (Y)

Referring to FIG. 16, the window overlap detector 46 comprises a flag register (X) 170 corresponding to the display lines in the vertical (X) direction of an FLCD 17, and a flag register (Y) 171 corresponding to the display lines in the horizontal (Y) direction of the FLCD 17.

A correspondence between the display screen of the FLCD 17 and the flag registers (X) 170 and (Y) 171 is shown in FIG. 16. When a window is open on the display screen of the FLCD 17, line addresses of the open window in the X and Y directions are obtained from a window register 120, and "1"s are respectively set in the flag registers (X) 170 and (Y) 171. When a new window is open, the contents of the flag registers (X) 170 and (Y) 171 which correspond to the previously open window are saved in comparators (X) 172 and (Y) 173. The flag registers (X) 170 and (Y) 171 corresponding to the X and Y directions of the newly open window are set at "1". The contents set in the flag registers (X) 170 and (Y) 171 are compared with the contents saved in the comparators (X) 172 and (Y) 173. If any line set at "1" in both the directions is present, two windows are discriminated to overlap each other. A window overlap flag 174 is set. A CPU 1 can refer to the window overlap flag 174 through a data bus driver 47 to detect whether the windows overlap each other.

(Fourth Embodiment)

In the first embodiment, the means for discriminating the active window comprises the means for calculating a cursor position and detecting a window in which the cursor is present when a plurality of windows are open and these windows are displayed on the display screen. In the fourth embodiment, a means for causing a user of this system to arbitrarily select an active window will be described.

Figure 17:
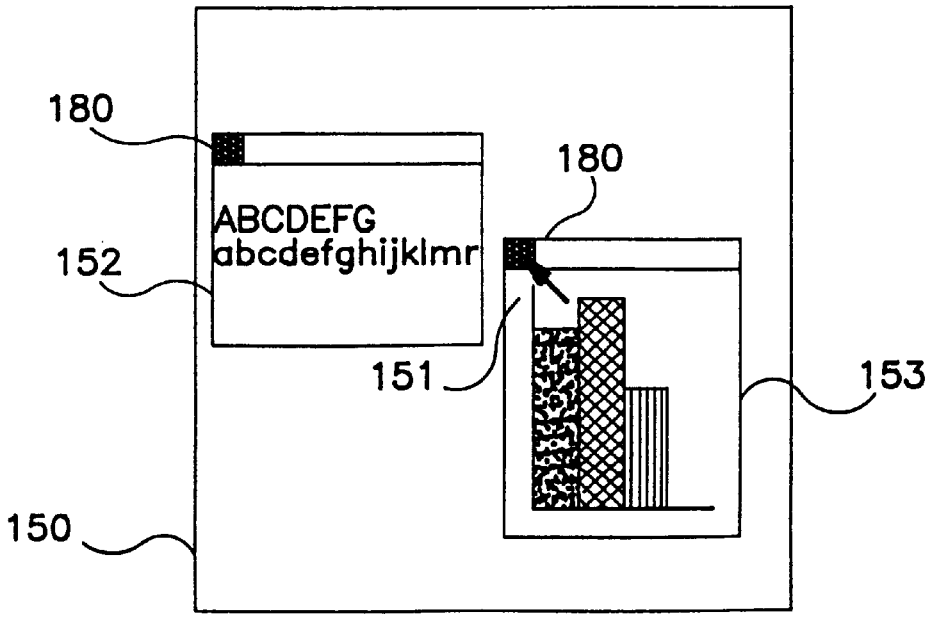
FIG. 17 is a view showing the display screen of an FLCD 17 according to the fourth embodiment of the present invention.

FIG. 17 shows a display screen state of an FLCD 17 of this embodiment. The same reference numerals as in FIG. 9 denote the same parts in FIG. 17. FIG. 17 shows the state in which two windows are displayed on the display screen. Referring to FIG. 17, each active area 180 is an area for setting an active window. When a cursor is placed in each active area 180, and the operator clicks a button on a mouse 15, the active flag of the attribute data corresponding to the corresponding window input in a window register 120 is set, and the window having the clicked active area 180 is defined as an active window subjected to partial rewriting. In this embodiment, two windows are open. However, the same control as described above can be performed even if three or more windows are open.

The means for discriminating the active window is not limited to the one exemplified in this embodiment. An active window may be discriminated by a means employed by application software. In this embodiment, the active area 180 is formed to designate the active area. However, a cursor may be placed in a window and is clicked to set this window as an active window. In this case, the active window is discriminated in accordance with the coordinate position, size, and height of the window and the cursor position.

As has been described above, according to the present invention, in the process for executing a cycle for sequentially rewriting the entire screen, a means for executing a cycle for updating the display of a portion whose display contents are changed by a host device such as a CPU is arranged. A means for representing that the portion whose display contents are changed is not updated on the display screen is arranged. A means for executing the cycle for updating the display of the portion whose display contents are changed from the host device such as the CPU within a specified range is arranged. A means for determining the number of cycles for updating the display of the portion, whose display contents are changed, in accordance with the number of portions whose display is not updated, among the portions whose display contents are changed, is also arranged. When an operation is performed in part of the display screen such as a window system, a currently operated region is rewritten at high speed, thereby obtaining high-quality display with sufficient utilization of the FLC characteristics.

What is claimed is:

1. A display control apparatus comprising:

storage means for storing information supplied from a processing apparatus;

detecting means for detecting a storage portion of the information;

first flag means comprising a plurality of flags each corresponding to one storage portion detected by said detecting means;

second flag means comprising a plurality of mask flags corresponding to each flag of said first flag means;

flag setting means for setting at least one of the plurality of flags on the basis of a detection result by said detecting means;

area setting means for setting at least one of the plurality of mask flags of said second flag means so as to set an extent in the plurality of flags;

checking means for checking whether or not each of the flags of said first flag means and said second flag means is set; and display control means for performing display on a display device on the basis of the information stored in said storage means and a checking result of said checking means.

2. An apparatus according to claim 1, further comprising display updating means and switching means, said updating means performing display on the display device on the basis of all information stored in said storage means, and said switching means switching between said display control means and said display updating means.

3. An apparatus according to claim 2, wherein said switching means preferentially performs display by said display control means.

4. An apparatus according to claim 2, further comprising counting means for counting a number of portions detected by said detecting means, and wherein said switching means performs switching on the basis of a count from said counting means.

5. An apparatus according to claim 1, wherein said detecting means detects an information rewritten portion of said storage means.

6. A display control apparatus comprising:

display means for displaying information;

storage means for storing information displayed on said display means;

supply means for supplying the information stored in said storage means;

detecting means for detecting a portion for storing the information supplied from said supply means;

first flag means comprising a plurality of flags each corresponding to one storage portion detected by said detecting means;

second flag means comprising a plurality of mask flags corresponding to each flag of said first flag means;

flag setting means for setting at least one of the plurality of flags on the basis of a detection result by said detecting means;

area setting means for setting at least one of the plurality of mask flags of said second flag means so as to set an extent in the plurality of flags;

checking means for checking whether or not each of the flags of said first flag means and said second flag means is set; and display control means for performing display on said display means on the basis of the information stored in said storage means and a checking result of said checking means.

7. An apparatus according to claim 6, further comprising display updating means and switching means, said updating means performing display on said display device on the basis of all information stored in said storage means, and said switching means switching between said display control means and said display updating means.

8. An apparatus according to claim 7, wherein said switching means preferentially performs display by said display control means.

9. An apparatus according to claim 7, further comprising counting means for counting a number of portions detected by said detecting means, and wherein said switching means performs switching on the basis of a count from said counting means.

10. An apparatus according to claim 6, wherein said detecting means detects an information rewritten portion of said storage means.

11. A display control method comprising the steps of:

storing information supplied from a processor into a memory;

detecting a storage portion of the information from a specific range;

providing a plurality of first flags each corresponding to one of the detected storage portions;

providing a plurality of mask flags corresponding to each of the first flags;

setting at least one of the plurality of flags based on the detected storage portion;

setting at least one of the plurality of mask flags so as to set an extent in the plurality of flags;

checking whether or not each of the flags and the mask flags in the extent is set; and performing a display on a display device on the basis of the information stored in a storage area and the results of checking the flags and the mask flags in the extent.

* * * * *

UNITED STATES PATENT AND TRADEMARK OFFICE

CERTIFICATE OF CORRECTION

PATENT NO. : 5,926,159

DATED : July 20, 1999

INVENTOR(S): EIICHI MATSUZAKI, ET AL.

It is certified that error appears in the above-identified patent and that said Letters Patent is hereby corrected as shown below:

Title page,

[56] REFERENCES CITED:

FOREIGN PATENT DOCUMENTS, "6276357" should read --62-76357--.

COLUMN 1:

Line 22, "CTR" should read --CRT--.
Line 26, "CTR" should read --CRT--.
Line 49, "CTR" should read --CRT--.

COLUMN 3:

Line 40,"and" should read --or--.

Signed and Sealed this

Fourth Day of July, 2000

*Attest:*

Q. TODD DICKINSON

*Attesting Officer*

*Director of Patents and Trademarks*